United States Patent [19]

Carnes, Jr. et al.

[11] 3,976,198

[45] Aug. 24, 1976

[54] METHOD AND APPARATUS FOR SORTING CURRENCY

[75] Inventors: W. Robert Carnes, Jr., Darien; Lester L. Selnick, Ridgefield; John Balogh, Jr., Trumbull, all of Conn.

[73] Assignee: Pitney-Bowes, Inc., Stamford, Conn.

[22] Filed: Aug. 11, 1975

[21] Appl. No.: 599,982

Related U.S. Application Data

[63] Continuation of Ser. No. 457,366, April 2, 1974, abandoned.

[52] U.S. Cl. ..... 209/111.7 T; 209/DIG. 2; 250/223 R; 356/201; 356/239; 271/64; 271/263

[51] Int. Cl.[2] ..... B07C 5/10

[58] Field of Search ..... 209/73, 111.7 T, DIG. 2; 250/216, 222, 223 R, 556, 555, 571, 578, 569; 356/71, 201, 206, 239, 168; 93/93 D, 93 C, 93 K; 271/64, 262, 263

[56] References Cited

UNITED STATES PATENTS

| | | | |
|---|---|---|---|
| 3,105,151 | 9/1963 | Nash | 250/223 R X |
| 3,280,974 | 10/1966 | Riddle et al. | 209/111.8 |
| 3,435,241 | 3/1969 | Hickey et al. | 250/571 X |
| 3,679,314 | 7/1972 | Mustert | 209/DIG 2 |
| 3,759,382 | 9/1973 | Walkley et al. | 209/DIG. 2 |

*Primary Examiner*—Robert B. Reeves
*Assistant Examiner*—Joseph J. Rolla
*Attorney, Agent, or Firm*—William D. Soltow, Jr.; Albert W. Scribner; Robert S. Salzman

[57] ABSTRACT

A method of currency examination is provided by transporting a bill through an examination station, projecting a beam of light at the bill as the bill is transported through the station, sensing and integrating light transmissivity of the bill over a principle portion of the area of a bill during transport of the bill past the beam of light, transporting the bill over a first course and depositing the bill in a first collection means when the bill exhibits a predetermined light transmissivity characteristic representative of a fit bill and alternatively transporting the bill over a second course and depositing the bill in a second collection means when the bill exhibits a predetermined light transmissivity characteristic representative of an unfit bill. Those bills transported over the second course are demonitized during transport. An apparatus for carrying out the method of the invention is described.

9 Claims, 14 Drawing Figures

METHOD AND APPARATUS FOR SORTING CURRENCY

This is a continuation of application Ser. No. 457,366 filed Apr. 2, 1974, now abandoned.

This invention relates to a method and an apparatus for automatically sorting unfit currency from fit currency. The invention relates more particularly to an improved method and apparatus for enhancing the sorting procedure and for increasing the security against loss or theft of currency during the procedure.

Currency which has been in circulation for a period of time becomes soiled, worn, and at times damaged and is no longer considered fit for continued use. The unfit currency is removed from circulation and is destroyed. Federal Reserve Banks throughout the United have hahve been assigned the responsibility of separating the fit from unfit currency which is forwarded to them from correspondent banks. After sorting, unfit currency is batched and is transmitted to the Bureau of Printing and Engraving for destruction.

Many millions of dollars in unfit currency is removed from circulation daily and the examination and sorting of this currency becomes a significant task. In practice, currency is sorted manually by trained workers at the Federal Reserve Banks. The segregated unfit bills are then "demonetized" by marking or mutilating in a distinctive manner prior to destruction.

The transmittal, handling, accounting and security of currency has been accomplished by a procedure developed over the years whereby currency is collected into bundles or straps. A strap of currency, which is generally bound together by a paper belt, typically contains 100 bills of a same denomination. At times, the strap can contain a lesser or greater predetermined number of bills. During the fitness sorting procedure, an original strap is broken by a worker; the bills of the strap are visually examined; and the bills are regrouped into a pile containing only fit bills and a pile containing only unfit bills. Upon depletion of an original strap of bills, the bills in the fit and unfit piles are counted in order to verify that the original strap contained a full complement of bills. After verification of the count, straps of fit bills are formed for recirculation while straps of unfit bills are formed for subsequent demonetizing and destruction. The demonetizing is then subsequently accomplished by breaking a strap of unfit bills, permanently marking or mutilating the bills, recounting the demonetized bills and again forming the same into a strap for transmittal to the Bureau of Printing and Engraving for destruction.

The described fitness sorting and demonetizing process is disadvantageous in several respects. Although workers are trained for making a visual examination of the fitness of a bill, the determination is a subjective one which is made during a tedious repetitive process and the results often vary significantly within a Federal Reserve Bank and between the different Federal Reserve Banks. In addition, the necessity for establishing an accurate accounting and security for fit, unfit, and demonetized bills further complicates the overall fitness examination and demonetizing procedure.

Nonetheless, the use of the strap procedure for transmitting and handling currency has merits which recommend its continued use. It would be desirable however, to automate some of the manually performed tasks with a method and apparatus which is compatible with this procedure. While machine methods for sorting fit and unfit currency and for demonetizing unfit currency are known, these methods are generally complex, expensive, time consuming and are either incompatible or inconvenient for use with the strap procedure of handling currency. In addition, they are susceptible to defeat by defects in the currency or in the handling of the currency which heretofore were correctable by a worker during a manual sorting process or which, by virtue of the manual nature of the handling, did not occur. These defects are, for example, the adhesion of one bill to another; the overlapping of successively fed bills at an automated examination station, and the severe mutilation of bills being examined. Furthermore, known apparatus for the demonetizing of unfit bills have not provided the degree of security necessary to guarantee against the theft of unfit currency and the unauthorized reintroduction of demonetized currency into circulation.

Accordingly, it is an object of this invention to provide an improved method and apparatus for sorting fit and unfit currency.

Another object of the invention is to provide a currency fitness determination apparatus which simulates to a relatively high degree the examination of a bill which has heretofore been performed by an individual.

Another object of the invention is to provide an improved apparatus for sorting fit and unfit currency and which provides for an accurate accounting of sorted bills and a verification of the number of bills introduced into the apparatus from a strap of bills.

Another object of the invention is to provide a currency fitness sorting apparatus which is also adapted for demonetizing unfit currency.

Another object of the invention is to provide an improved method and apparatus for sorting and demonetizing currency and which is convenient for use with the strap procedure of handling currency.

A further object of the invention is to provide a currency fitness sorting apparatus having means for detecting and indicating the introduction of demonetized currency into the apparatus.

Another object of the invention is to provide an improved apparatus for sorting and accounting for fit and unfit bills and which is adapted for sensing the introduction to the examination station of a double thickness of bills resulting from the overlapping or the adhesion of single bills to each other and for segregating these bills.

Another object of the invention is to provide a currency fitness sorting apparatus which is adapted for collecting fit and unfit bills into straps of a selectable number of bills.

Another object of the invention is to provide an apparatus adapted for examining, in addition to currency, other value documents, as for example treasure notes and food stamps.

Still another object of the invention is to provide a currency fitness sorting apparatus having an improved optical examination means for determining the fitness or unfitness of a bill.

Examination of currency with a known method is provided by projecting light at a bill and utilizing an optical characteristic of the bill for making a determination as to the fitness or unfitness of bill. This determination is reached by utilizing a known characteristic of a bill whereby the light transmissivity of a bill is decreased as the fitness of the bill is reduced over its useful life from its fitness at its initial entry into circulation. A reference level of light transmissivity is established which is representative of the lowest degree of acceptable currency fitness and the light transmissivity of bills under examination is compared with this level in making a determination as to fitness or unfitness. There is disclosed in U.S. Pat. No. 3,759,382, which is assigned to the asignee of this invention, the recognition that currency which has been in circulation exhibits an increasing opaqueness to light in the spectral range of around 4800 angstroms.

The method of the present invention is carried out by transporting a bill through an examination station, projecting a beam of light at the bill as the bill is transported through the station, sensing and integrating the light transmissivity of the bill over a principle portion of the area of the bill during transport of the bill past the beam of light, transporting the bill over a first course and depositing the bill in a first collection means when the bill exhibits a predetermined light transmissivity characteristic representative of a fit bill and alternatively transporting the bill over a second course and depositing the bill in a second collection means when the bill exhibits a predetermined light transmissivity characteristic representative of an unfit bill. A more particular feature of the method of the invention provides for demonetizing bills which are transported along the second course.

In accordance with the general features of the apparatus of this invention, a transport means is provided for receiving and transporting a bill being examined through an examination station. There is provided an examination station having a means for projecting a beam of light at a bill and for integrating light transmission through the bill over a principal portion of the area of a bill. Means are proviced for comparing the transmissivity of the bill with a predetermined reference and determining the fit or unfit character of the bill. A transport means conveys the examined bill from the examination station to a gating station where means, in accordance with the fitness determination, direct a fit bill through a first course to a first bill collecting means and alternatively an unfit bill over a second course to a second bill collecting means. In accordance with another feature of the invention, the bills which are transported through the second course are conveyed through a demonetizing station at which location the bills are demonitized prior to depositing in the second bill collecting means.

In accordance with more particular features of the apparatus of this invention, a means responsive to the light transmissivity of bills introduced to the examination station is provided for diverting to a return station those bills which, because of a substantially reduced light transmissivity, are determined to be adhering, overlapping or to exhibit defects characterized by a substantially low transmissivity.

The demonitizing features of the invention further include means for sensing the introduction of a demonetized bill into the apparatus and means for sensing a malfunction at the demonetizing station and for inhibiting operation of the apparatus when these events are detected.

The apparatus is particularly useful with the strap procedure for handling currency and means are provided for automatically depositing strap separators into the bill stacking bins to form straps of bills of selectable, predetermined numbers. Means are provided for automatically interrupting operation of the apparatus when a strap of bills has been introduced into the apparatus an for displaying an indication of the number of sorted fit and unfit bills from the strap which have been examined, for visually displaying the total number of fit bills which have been deposited in a first bin, the total number of fit bills which have been deposited in a second bin and for simultaneously restarting the apparatus and transferring the bills in the fit and unfit bins to fit and unfit stackers respectively.

These and other objects and features of the invention will become apparent with reference to the following specification and to the drawings wherein.

GENERAL DESCRIPTION OF THE APPARATUS

Figure 1:
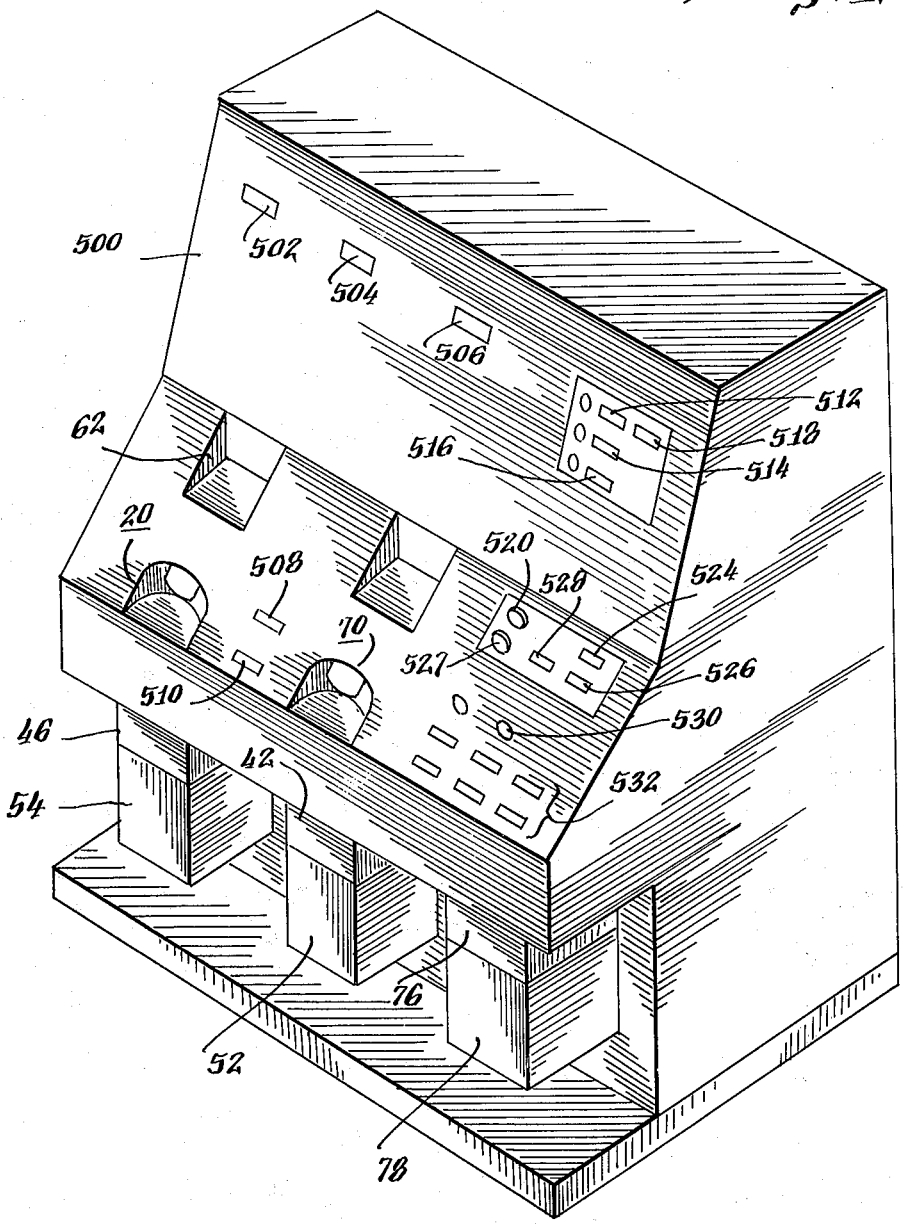
FIG. 1 is a perspective view of a cabinet and operator console of one embodiment of the apparatus of this invention.

The introduction and the progress of bills through the apparatus will be described generally with reference to FIG. 2. Individual bills 17 are removed from a strap of bills 18 by an operator and are manually introduced in a direction along a principle axis 19 of the bill to a scanning head 20. The bills thus introduced are automatically conveyed through the head 20 and are examined, as indicated in greater detail hereinafter to determine whether the bill is fit or unfit for continued circulation.

After examination, a bill is automatically conveyed from the scanning head 20 through an outlet slit 22 to a transport belt 24. The belt 24 and a guide 23 convey an examined bill through a first "doubles" directional gate station 25, the function of which is described hereinafter, and then to a second fit/unfit directional gate station 26. The gate station 26 includes a solenoid 28 which actuates a plurality of directional guide fingers 32*a* and 32*b*. When a bill which is being transported to the station 26 has been determined by the apparatus to be fit, the solenoid 28 is energized thereby actuating the fingers 32 and causing the direction of transport of the bill to be directed over a first course indicated by the solid arrows. A bill is conveyed over segments of a first course by a belt transport 34 and guide 35, a belt transport 36 and guide 37, belt transports 38 and 39 which provide lateral translation in the transport of a bill with respect to its initial direction of motion along the belt 24, and a transport belt 40 and guide 41 which transport and deposit a fit bill 17 in an upper stacker of bin 42.

When a bill being examined has been determined to be unfit for continued circulation, the solenoid 28 remains in a deenergized state and an unfit bill is transported from the gate station 26 over a second course, indicated by the dashed arrows, through a demonetizing station 44, through a postprint detection station 45, and to an upper stacker or bin 46. A bill is transported over segments of this second course by the transport belt 24 and guide 35 and by the transport belt 24 and a transport belt 47. Its the demonetizing station 44, the bill is conveyed between a pair of printing rollers which print a demonetizing marking in ink on the bill. The bill is then examined at the detectionn station 45 for the presence or absence of a demonitizing marking. The absence of a demonetizing marking indicates a malfunction at the demonetizing station 44 and operation of the apparatus is automatically interruped. However, when a demonetizing marking is determined to be present on the bill, the bill is transported to and deposited in the upper unfit bill stacker 46. During operation of the apparatus, the transport belts are continuously drive and the motion of a bill over the first or second course and through the various stations is continuous.

In order to provide an accounting and a verification of the number of bills which are removed from the strap 18, and which are fed to the apparatus, the scanning head 20 and an associated electrical circuit means provides a count and a display of the count of those bills which are transported through the head and which are determined not to be double or overlapping. In addition, a counter detector means 48 is provided for counting the number of unfit bills which are transported to and deposited in the upper stacker 46 and a counter detector means 49 is provided for counting the number of fit bills which are transported to and deposited in the upper stacker 42. A visual display indicative of the number of fit bills collected in the upper stacker 42 and unfit bills collected in the upper stacker 46 during the sorting of a strap is thereby provided. When a strap 18 is depleted, and a number of bills equal to a predetermined strap number has introduced into the scanning head 20, the apparatus will automatically transfer into a stop mode. At this time, the operator can, from the displayed counts, verify the number of bills in the strap. When the number of bills entered into the scanning head 20 is less than the predetermined number of bills in a strap, an error or security breach is indicated and the operation of the machine can be terminated until the reason for the discrepancy is determined.

Upon verification, the operation of the apparatus is reinitiated by the operator through actuation of a start switch which transfers the apparatus into an operating mode. At this time, those bills in the upper stackers 42 and 46 are automatically transferred to lower stackers 52 and 54 respectively by the opening of lower doors in each of the upper stackers. The upper stackers which are then emptied are conditioned to receive fit and unfit bills from a succeeding strap.

The apparatus retains tallies of the number of bills which have been dorted into each of the upper fit and unfit bill stackers 42 and 46 respectively. When this tally of fit of unfit bills is equal to a predetermined strap numbers, a separator card 56 is automatically transferred into an upper stacker 42 or 46. The separator cards 56 are stored in card bins 58 and 60 respectively. A separating card will be transferred to the lower stackers from the upper stackers along with the bills contained therein upon completion and verification of a strap. After the lower stacker units are filled to capacity, an indication is provided and the fit bills can be removed and bound into straps for subsequent destruction.

The introduction of bills, under certain conditions, will result in a light transmissivity which is substantially lower than the transmissivity of an unfit bill. This condition occurs for example, when one bill adheres to another and these "doubles" are fed to the scanner head 20. This condition can also occur when bills which are fed seriatim are fed at a rate which causes them to overlap at the examination station. It is desirable that these bills be inhibited from traversing the first and second courses and that they be removed from the apparatus and be delivered to a station at which the operator can examine them and decide as to the feasibility of reinsertion. For example, bills which are introduced in an overlapping manner and bills which are lightly adhering one to the other can be separated and be reintroduced while bills which cannot be readily separated or bills which are severely soiled can be removed for individual treatment. The apparatus is adapted for sensing when doubles have been introduced into the machine, for diverting their passage prior to reaching the fit/unfit gate station 26, and for returning these bills to a return shelf 62 at the operators station. Those bills which exhibit a substantially low transmissivity conforming to a predetermined doubles reference level and which level is substantially lower than a reference level for distinguishing fit from unfit bills are detected by the apparatus upon examination by the scanner head 20. A double bill is transported to the double gate station 25 at which location a solenoid 64 is energized. The energized solenoid actuates a plurality of direction diverting fingers **66*a* and 66*b*. As a double bill is transported from the slot 22 by the belt 24 and guide 23, its direction of transport is altered by the fingers 66a which cause it to travel over a course indicated by the curved dashed line between a return roll 68 and guide 69 to the return tray 62. The apparatus inhibits entry of a count into the strap counter and strap count verification is not affected. Those returned double bills which cannot be reentered because of their condition are available to the operator for accounting when verifying the total number of bills derived from a strap 18**.

It is desirable, for security reasons, that the apparatus recognize when a bill which is demonetizing is fed to the apparatus. The scanner head 20 includes a detection means for sensing the presence of a demonetizing marking on a bill at the examination station. When this marking is detected, the apparatus is automatically transferred into a stop, locked mode and the apparatus cannot be restarted without the actuation of a keylock, the key for which is maintained under the control of a supervisory operator.

In addition to United States currency, the Federal Reserve Banks are required at times to process other special forms of value paper such as Treasury Notes, Food Stamps, etc. While processing of this value paper generally does not require separation based on fitness, the paper is handled in straps and generally requires counting, verification, forming into straps and at times "devalueing". The apparatus illustrated in FIG. 2 includes a second scanning head 70 to which this special paper is fed for processing. The scanning head 70, for value paper, operates as a strap counter detector. After the paper is examined, it is conveyed from an exit aperture 71 and is transported by a belt 72 over a course indicates by solid arrows to an upper stacker 76. For purposes of simplifying the drawing, the additional belt and guides for transporting the paper over the course is not illustrated but it is understood that guides equivalent to the guides 23, 35, and 69 and a transport belt equivalent to the belt 47 which are employed with belt 24 are employed with the transport belt 72. A counter detector 77 is provided for sensing paper which is transported to and deposited in the upper stacker 76. When the transmissivity of the document is less than the pre-established doubles reference, a doubles gate station solenoid 78 is energized for actuating direction diverting fingers 80 and diverting the transport of the paper to a return tray 77. Those documents which are introduced into the upper stacker 76 are transferred to a lower stacker 78 when a number of value papers equal to the number in a desired strap have been deposited in the upper stacker. In addition, a separator card 56 from a separator bin 80 is deposited in the upper stacker when a number of papers equal to the strap number have been sorted and is transferred with the value paper in the upper stacker to the lower stacker 78. A doubles transport arrangement, which again for the purpose of simplifying FIG. 2 is not illustrated, is understood to include a roller and guide and a return tray equivalent to the roller 68 and guide 69 and return tray 62.

Figure 2:
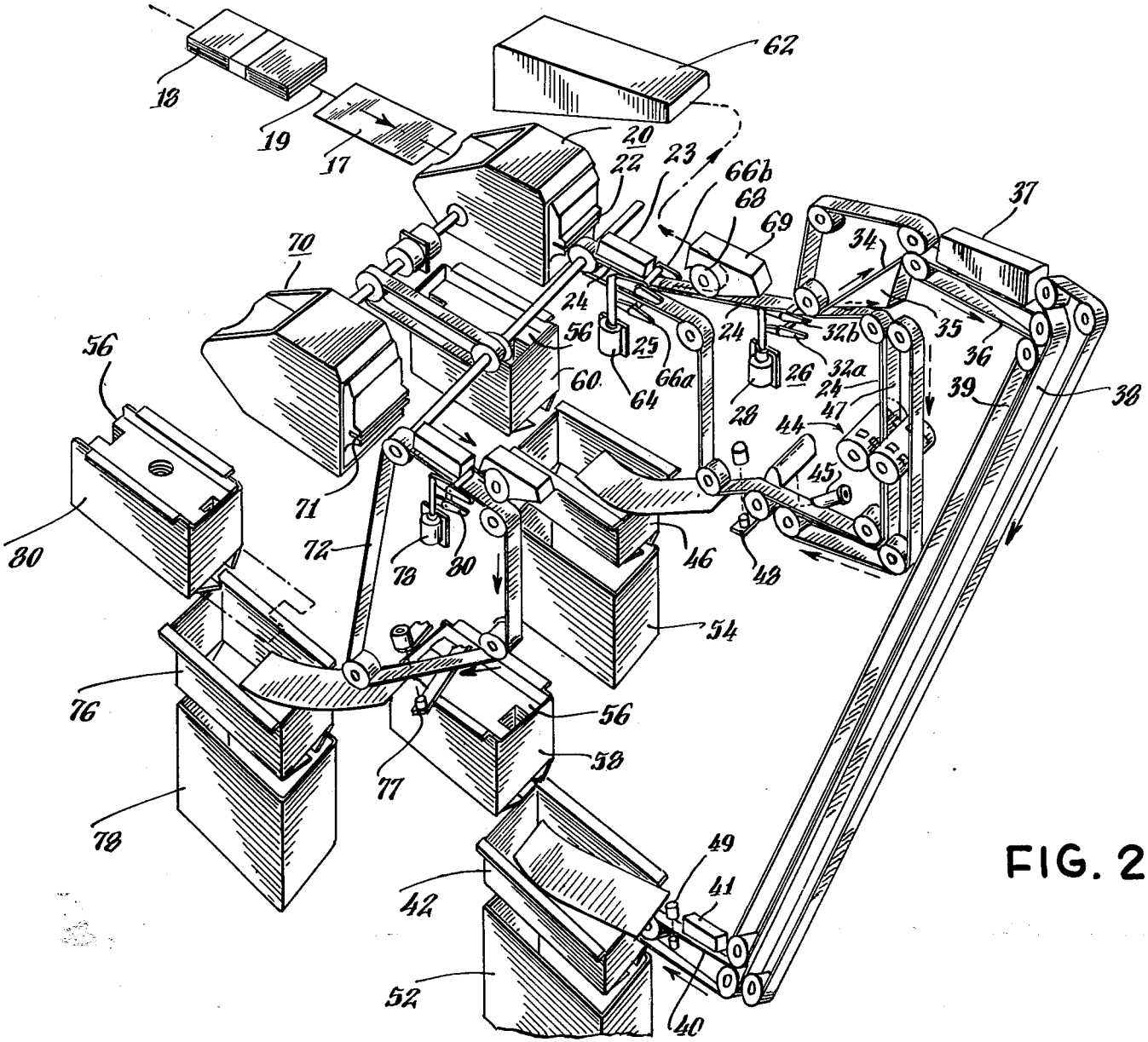
FIG. 2 is a perspective view of the apparatus of FIG. 1 which is simplified for illustrating the transport of bills and value documents through various operational stations of the apparatus.

In addition to that portion of the apparatus which has been described generally thusfar with respect to FIG. 2, there is also provided circuit means for causing various machine operations in response to the information contained in signals received from the scanner and the various detectors. The circuit means, which is described in greater detail hereinafter, operates to effect operation of the doubles gate station 25, operation of the fit or unfit gate at station 26, operation of the strap card separator, transfer of the bills in an upper stacker to a lower stacker, and for causing the machine to transfer from an operating mode to a stop mode when a number of bills equal to a predetermined number of bills in a strap has been introduced and sorted by the apparatus, when a malfunction in the demonetizer is detected, and when a demonetized bill is introduced into the apparatus.

DETAILED DESCRIPTION OF APPARATUS SCANNER HEAD

The apparatus will not be described in greater detail with reference to FIGS. 3 through 9. Those members of the apparatus of FIGS. 3 through 9 which perform similar functions as apparatus members described with reference to FIG. 2 bear the same reference numerals in FIGS. 2 through 9. The scanner head at the station 20, as illustrated in detail in FIG. 8, includes a housing formed by aluminum blocks of metal having an upper segment 100 and 102 and side wall members 103 and 105 (FIG. 6). A means for transporting a bill or document to be analyzed through the housing includes a drive roll 104 which is mounted on a shaft 106 for rotation therewith and is positioned in the lower housing member 102. a rubber collar 107 is positioned on the roller for contacting bills. The shaft 106 is mechanically coupled to a drive pulley 438 (FIG. 6) through a clutch and brake coupling 440. A pinch roll 110 is provided and is mounted to the upper housing member 100 in contact with the drive surface of the drive roll 104. The pinch roll is rotatably mounted about a shaft 112 which is supported in a bracket 114. This bracket is pivotally mounted to the housing member 100 by pins 114 and is secured thereto by a screw 116. A coil spring 118, which is positioned about the screw 116 provides a resilient biasing of the pinch roll 110 against the drive roll 104.

The scanner head drive is particularly adapted for accommodating currency as it is presently manually handled by workers in the Federal Reserve banks. During present day sorting processing, the workers generally fold the bills at an angle of about 45° along the principle axis 19 (FIG. 10) of a bill. With manual processing of bills, this folding has heretofore enhanced the rapid separation and sorting of bills. The scanning head 20 is adapted for receiving currency thus folded. An entrance plate 120 is provided upon which the folded bills are deposited by the operator. A bill is manually advanced a distance sufficient for feeding a leading edge of the bill between the drive roller 104 and the pinch roller 110. The drive roller 104 further includes levelled shoulder segments 122 and 124 (FIG. 6) which receive the bill with folded edges in the condition as processed by the operator. The plate 120 further includes curved guide shoulders 128 and 130 which facilitate guiding a folded bill between the drive and pinch rollers. A received bill is transported by the action of the drive and pinch rollers between the upper and lower housing members through an examination station 133 to the outlet aperture 22. In general, a bill will have a length sufficiently large for providing that the leading edge of the bill, as it exits from the aperture 22, will be engaged by the drive belt 24 and a pinch roll 132 before it becomes disengaged from the drive and pinch rolls 104 and 110.

In accordance with a feature of the invention, an optical examination of the bill is performed at the examination station of the scanner head by projecting a light beam at the surface of a bill and over a substantially principle area of the bill as the bill is continuously transported through the examination station. The light transmissivity or conversely the opacity, of the bill is optically integrated over this area and the transmissivity over the length of the bill is electrically integrated to provide a relatively high degree of transmissivity discrimination for distinguishing between fit and unfit bills and between unfit bills and doubles. A means for transmitting a light beam at a bill comprises a light source having a lamp 140 which is mounted in the upper housing member 100 and a polished surface 142 which is provided for reflecting light from the lamp 140 toward a bill positioned on a glass window 144 at the examination station. Light transmitted through a bill impinges upon a parabolic reflective surface 146 which has a phototransistor 148 positioned at its focal point. The phototransistor is supported in the path of transmitted light by a thin-walled, three-legged, spider mount 152. Light which is transmitted through the bill and which impinges upon the reflective surface 146 is collected or optically integrated by reflection at its focal point and at the phototransistor 148. An output signal from the phototransistor is, as indicated in greater detail hereinafter, coupled to a preamplifier and to circuit integrating means for integrating the transmissivity of the bill over the length of the bill during its transit through the examination station to provide a high degree of transmissivity discrimination.

Figure 7:
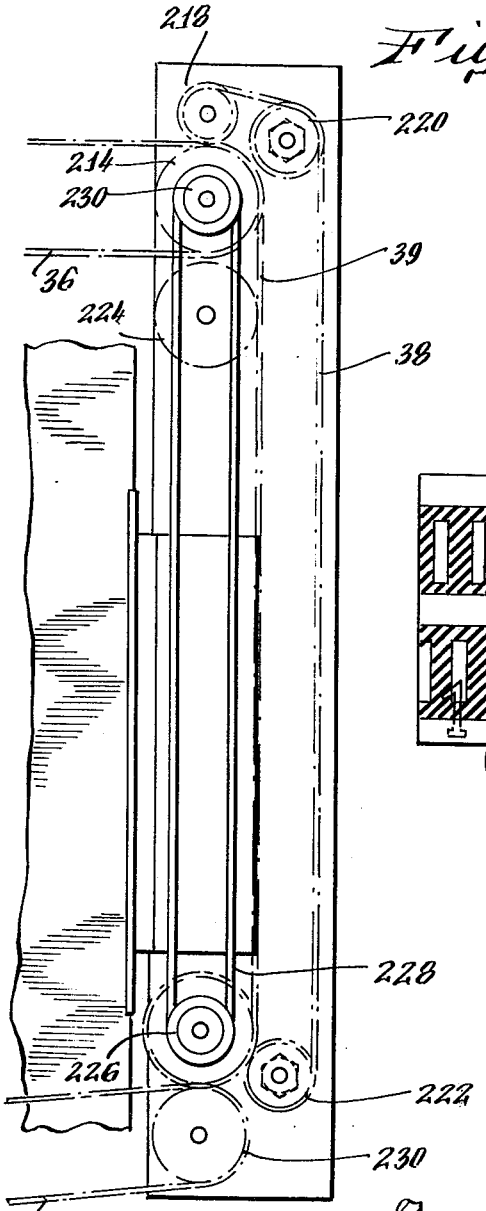
FIG. 7 is a view taken along lines 7—7 of FIG. 5.

The scanner 20 is also adapted to detect by reflective optical techniques certain characteristics of a bill such as the impression of a demonetizing marking on the bill, characteristics indicating the counterfeit nature of a bill, etc. A plurality of optical detectors 154, 156 and 158 is provided. Each detector includes a generally tubular shaped shade which is mounted in an associated bore such as the shade 159 in bore 160 of the detector 156. The shades are inclined at an angle with respect to the glass plate 144. A shade is secured in its bore by a set screw such as the set screw 162. There is mounted within each of the shades a lens 164 and a photodiode 166. The lens 164 is positioned for focusing reflected light from a predetermined location on a bill onto the photodiode 166. For example, and as illustrated in FIG. 7, a demonetized bill 168 bears a demonetizing marking comprising a substantially opaque ink frame 169 defining a plurality of light transmissive rectangular shaped bars 170 formed into columns 172 and 174 along the bill. This marking is printed on each surface of the bill. The detectors 154 and 158 will sense the periodic reflection of light from the bill as the bars 170 on a transported demonetized bill are advanced through the examination station. Output signals from these diodes are pre-amplified, as indicated in greater detail hereinafter and are coupled to circuit means which is adapted for recognizing the demonetizing pattern and providing an indication thereof. In general, the occurrence of such a pattern represents the entry of a preprinted (i.e. demonetized) bill into the scanner head and will cause the interruption to the operation of the apparatus.

During a strap sorting mode of operation, the pinch wheel 104 will be continuously rotating and the machine is ready to receive a continuous feed of bills from a strap. This ready feed condition of the input drive means for the scanner head will continue throughout the feed of bills until the predetermined strap number of bills has been introduced into the machine at which time rotation of the drive shaft 106 is terminated by the energization of the input drive clutch and drive brake 440. In addition, a main input drive is also terminated and braked when the apparatus detects the introduction of a demonetized bill at the scanner head 20.

The scanner head 20 and the scanner head 70 are described in greater detail and are claimed in a copending U.S. Pat. application, Ser. No. 457,368 now U.S. Patent No. 3,938,663, filed concurrently herewith and assigned to the assignee of this invention. The disclosure of this copending application is incorporated herein by reference.

BILL TRANSPORT AND DIRECTION CONTROL

A bill exiting from the scanner head 20 at the aperture 22 (FIG. 3) is directed between the roller 132 and the belt 24. The bill is then transported by the belt to the doubles gate station 25. The belt 24 comprises a COG timing belt which meshes with gears formed on timing belt pulleys 180, 182, 184 and 186 and on a driven pulley 188. A bill is transported on the upper flat surface of the belt 24 to the doubles gate station 25. During its transport, the bill is secured on the belt surface by the guide 23 comprising a slotted hold-down plate and roller guides 190 and 192.

Figures 3, 13:
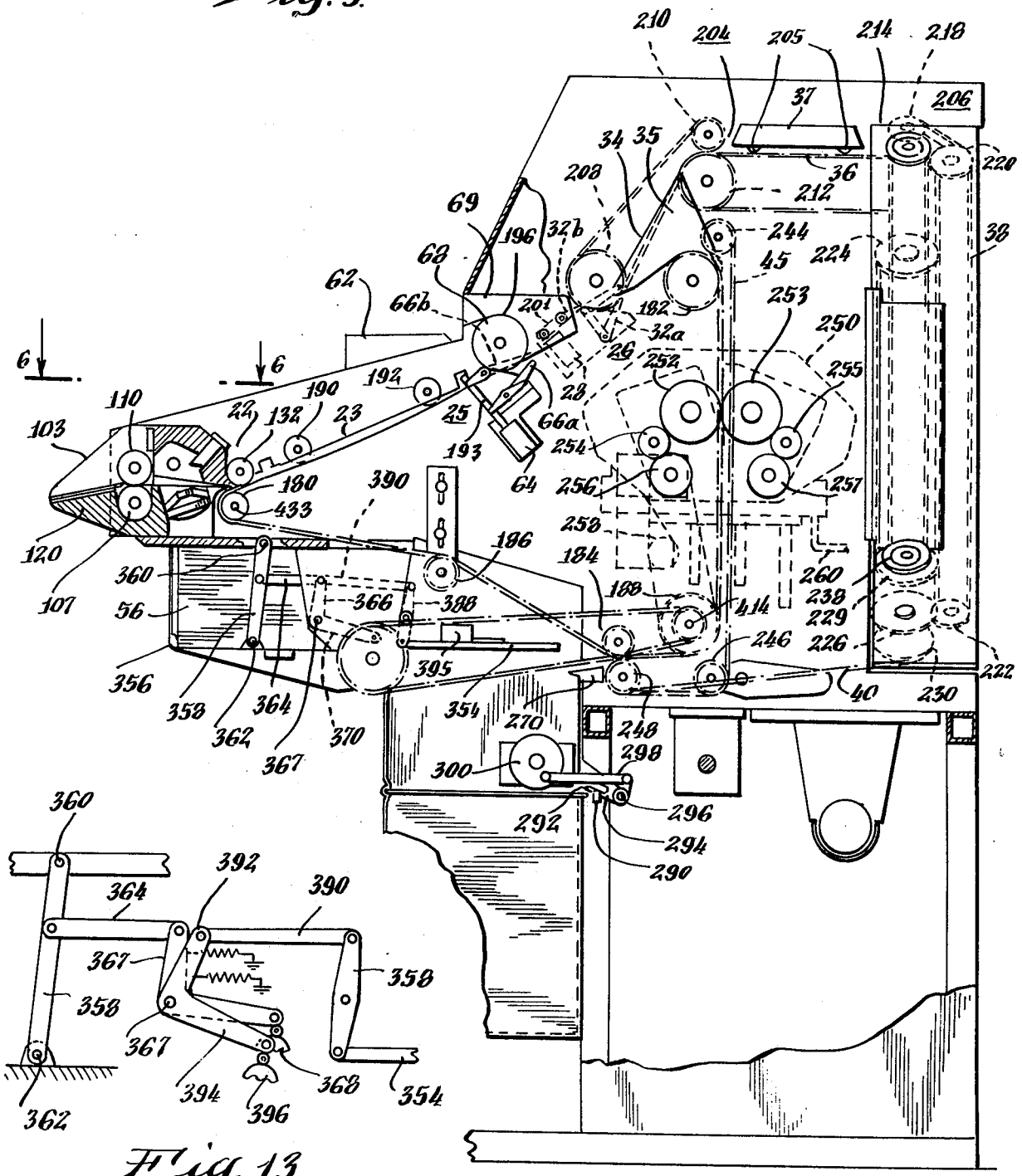
FIG. 3 is a side elevation view, partly broken away, of the apparatus of FIG. 1.
FIG. 13 is an enlarged view of a portion of a card separator feed means of FIG. 3; and, FIG. 14 is a generalized electronic system diagram explaining the control interrelationships of the present invention.

The doubles gate station 25 includes the doubles gate solenoid 64, a mechanical linkage 193, and the directional diverting fingers 66a and 66b. In addition to these elements, the doubles gate station 25 includes the plastic guide block 69 having an arcuate surface 196 and the drive roller 68 having a diameter which provides a circumference conforming to the arcuate segment 196. In de-energized condition, as illustrated in FIG. 3, the solenoid armature is extended thereby causing the linkage 193 to position the guide finger **66*b* as indicated for causing a continued passage of a bill through the doubles gate station 25 to succeeding stations. However, when a double bill condition is detected by the apparatus, the solenoid 64 is automatically energized, its armature is drawn into the core and the linkage 193 is thereby operated against the tension of a biasing spring, not illustrated, for causing the finger 66a to extend upwardly and cause a bill to follow the arcuate path 196 between the block 69 and the roller 196. The direction of transport of the bill is thus diverted and the bill is deposited in the return tray 62.**

A bill which is determined not to satisfy the doubles conditions is transported through the double gate station 25 by the belt 24 and a guide surface of block 69 to the Fit/Unfit gate station 25.

As indicated hereinbefore, the Fit/Unfit gate station 26 operates in response to a determination of the apparatus as to the condition of a bill and directs the bill alternatively over one of two courses. This directional control is provided by the solenoid 28 which is coupled by mechanical linkage 201 to directional controlling fingers **32*a* and 32*b*. When the solenoid 28 is energized as illustrated in FIG. 3, the finger 32a is positioned for raising the loading edge of a bill and directing its motion off the belt 24 and between a belt 34 and a guide surface 203 of the guide 35 to a transfer station 204 where the bill is then delivered for transport by the belt 36. The belt 34 comprises a timing belt which engages geared timing belt pulleys 208 and 210 and is driven by friction contact with the belt 36. A bill which is received by the belt 36 at transfer station 204 is transported by the belt 36 against rollers 205 of guide 37 to a bill transfer station 206. The transport belt 36 comprises a timing belt which is positioned about a timing belt pulley 212 and is driven by a geared drive wheel 214.**

Figure 9:
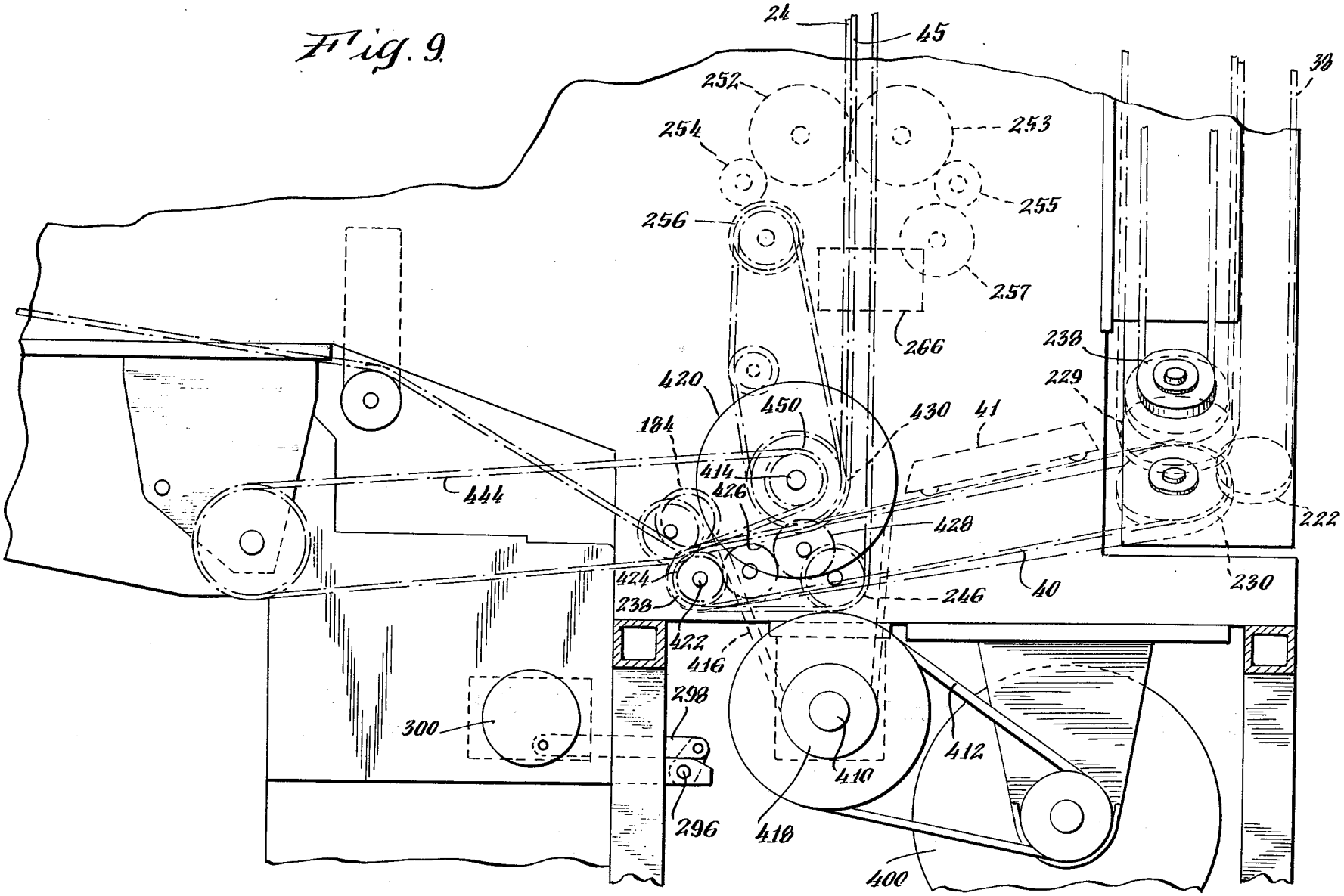
FIG. 9 is an enlarged view of a drive train of FIG. 3.

In providing a method and an apparatus which is compatible and convenient for use with the strap procedure for handling currency, it is desirable to present the sorted currency in juxtaposed stackers adjacent the operator's station so that the bills can be readily removed for examination and for binding into straps. During the transport of a fit bill over the first course, a bill is laterally translated by providing a belt transport arrangement which effects a lateral displacement relative to the orientation of the bill as it was introduced to the scanning head 20. This lateral displacement is provided by the transport belts 38 and 39. The belt 38 comprises a timing belt which is positioned about timing belt pulleys 218, 220 and 222 (FIGS. 3, 5 and 7), while the timing belt 39 is positioned about a timing belt pulley 224 and a drive gear 226. The drive pulley 226 is shaft coupled to a driven gear 229. A drive pulley 228 is also coupled by a timing drive belt 230 (FIG. 5) to a drive pulley 232 which is shaft coupled to the drive wheel 214 for driving the belt 39. The timing belt 38 is driven by friction contact with the belt 39. The axes of the pulleys and drive shafts upon which the belts 38 and 39 are mounted as well as the axes of the drive wheel 214 form an angle of about 45° with the axis of the pulley 212. There is thus a sideways or lateral translation of a bill with this transport arrangement. A bill which is conveyed by the belt 36 to the station 206 (FIG. 3) will be transported between the belts 38 and 39 to a lower laterally displaced station 233 (FIG. 5) in the apparatus and from which location the bill is delivered to the upper stacker 42 by the transport belt 40 and guide 41 (FIG. 9). The timing belt 40 is positioned about a first pulley 236 and is driven via second pulley 238 which is mounted for rotation with a shaft 422. The axis of the gear 238 is mounted parallel to the axis of the pulley 212 and a bill is delivered to the stacker 44 in a level plane substantially parallel to the plane of the bill upon initiation of transport by belt 24. The pulley 236 is shaft coupled to a gear 238 which engages and drives gear 229. The drive for transport belts 34, 37, 38 and 39 is thus derived from shaft 422 through transport belt 40.

When the solenoid 28 of the Fit/Unfit gate 26 is de-energized, the fingers 32*a* and 32*b* (FIG. 3) will be rotated clockwise and the finger 32*b* will cause the leading edge of a bill to remain in contact with belt 24. The bill thus travels on this belt between a surface of guide 35 to a location at which the surfaces of the belt 24 and the belt 45 contact. The transport belt 45 comprises a timing belt which is positioned about pulleys 244, 246 and 248. Belt 45 is driven by friction contact with the belt 24. A bill is transported in a vertical direction downwardly through demonetizing means, discussed hereinafter, and to an inlet station of the unfit bill upper stacker 44.

DEMONETIZER

Figure 10:
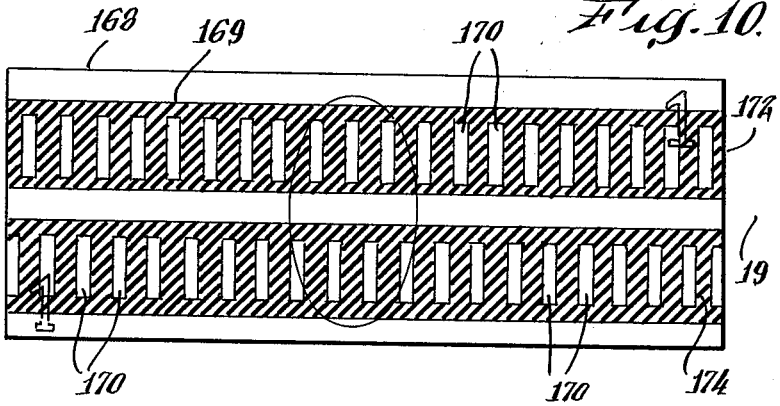
FIG. 10 is a view of a bill which has been demonitized by the apparatus of FIG. 1.
Figure 11:
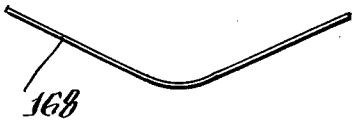
FIG. 11 is a side view of a bill which has been partly folded for manual handling.

In accordance with a feature of this invention, the unfit bills which have been sorted from fit bills and are transported over the second course toward the unfit bill stacker are demonetized. A demonetizing means comprises an inker printer 250. The printer includes a pair of printing rolls 252 and 253 in contact with ink transfer rolls 254 and 255 respectively. The inking rolls are positioned for rotatable contact with ink fountain rolls 256 and 257 respectively. This roller assembly is driven from the main drive shaft 414 by a drive belt 258. The printing rolls 252 and 253 each include a demonetizing pattern which is to be imprinted upon an unfit bill. A particular demonetizing pattern comprises equally spaced, rectangular, marks in an opaque ink frame which extend in parallel rows as illustrated in FIG. 10 on both faces of a bill. The printing rolls 252 and 253 include a pattern for forming these desired markings and an ink, preferably opaque, is supplied to the fountain rolls via an input inking line 260 and is applied to the inking rollers.

For security purposes, it is desirable to examine each bill which is transported through the inker-printer for sensing a malfunction in the inker-printer. A detector block 266 (FIGS. 5 and 9) is provided and is mounted adjacent the bill transport timing belts 24 and 45 near an exit location of the inker-printer 250. The detector block 266 includes a light source for illuminating each side of the transported bill and a plurality of detectors similar to the detectors for examining each row of demonetizing markings on each side of the bill. The output signals from these detectors are coupled to circuit means, described hereinafter, which sense for the absence of a demonetizing marking. When this condition is detected, the operation of the apparatus is automatically halted.

BILL STACKERS

Figure 4:
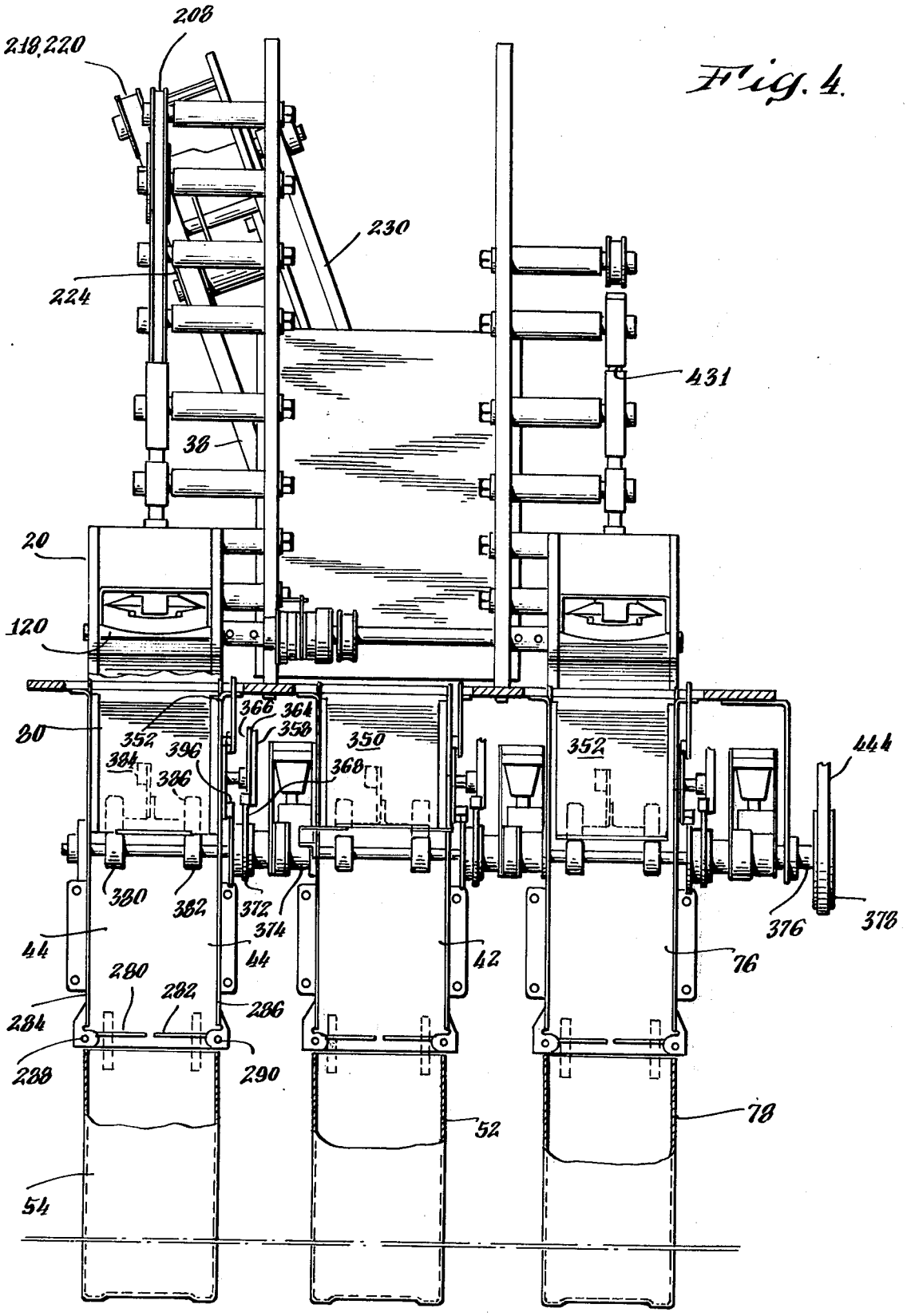
FIG. 4 is a front elevation view of the apparatus of FIG. 3.
Figure 12:
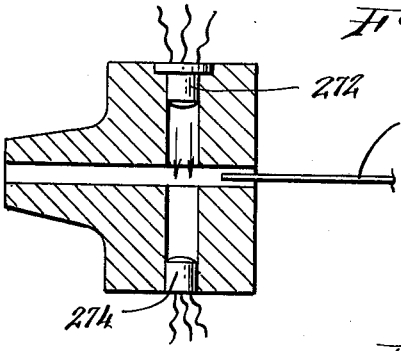
FIG. 12 is an enlarged view of a stacker detector block of FIG. 3.

The bills which are delivered to the stackers are introduced into each of the stackers through a channel in a count detector block, exemplified by the block 270 of the unfit stacker 44. This block whose general position is shown in FIG. 3 is illustrated in greater detail in FIG. 12. The detector includes a light source 272 and a phototransistor 274. The light source 272 is positioned for projecting light across the entrance channel to the diode 274 positioned on an opposite side of the channel. When a bill is delivered to the stacker, the light beam will be interrupted and an optical signal will be generated. This electrical signal is utilized for accumulating a count of a number of bills in an upper stacker for a strap and for maintaining a count of the number of bills in the lower stacker. The latter indication provides a control for automatically inserting a strap separator, as indicated in more detail hereinafter. Each of the upper stackers includes a detector block, as described, along with counter means for providing a display indicative of the introduction of a bill into the stacker. The upper stackers 44, 58 and 76 comprises sheet metal receptacles, conforming generally to the shape of a bill being sorted, which temporarily store the bills sorted to the associated stacker. The upper unfit bill stacker 44 which is exemplary, as illustrated in FIG. 4, includes a lower surface formed by a pair of door members 280 and 282 which are rotatably mounted near lower edges of side segments 284 and 286 respectively. The gates 280 and 282 are mounted on shafts 288 and 290 respectively. A collar 290 (FIG. 3) is positioned at one end of each of these shafts. A stud 292 is mounted in the collar and is engaged by a yoke shaped linkage member 294. The linkage member 294 is mounted on a shaft 296 which is rotatable by a mechanical linkage 298 which is actuated by a rotary solenoid means 300. As indicated hereinbefore, the introduction of a strap of bils into the apparatus results in the transfer of the apparatus to a stop mode. The operator then verifies the count of bills. Upon verification, the operator re-initiates operation of the machine. When operation is thus re-initiated, the machine automatically transfers the bills in an upper stacker to the lower stacker by actuating the soldenoid 300 and causing the doors 280 and 282 to rotate and permit the bills to drop into the lower stacker. The shaft 296 is also coupled to similar mechanical means for causing the simultaneous operation of the gates in the fit bill and special paper upper stackers.

BILL SEPARATOR

An automatic separator card inserter for forming the bills, which are transferred to a lower stacker, into straps of predetermined numbers includes separator card bins 80, 350 and 352 (FIG. 4). A plurality of separator cards is positioned in each of these bins and means are provided for automatically withdrawing a card from the bin and for transferring the card to the upper stacker of an associated bin. The means for accomplishing this transfer is the same for each of the bins and will be described in detail with reference to the card inserter for fit bills. As seen in FIGS. 3, 4 and 13, the insertion means comprises a means for bottom feeding a separating card from a stack 56, for transferring the separated card to a retractable support shelf referenced generally as 354, which is positioned above the upper stacker, and which is adapted for dropping a separated card into the upper stacker. The bottom feeding means includes a separating finger 356 (FIG. 3) which is operated by a mechanical linkage including an arm 358 which is pivotally mounted to the frame at location 360 and which is coupled to the finger 356 at a flange 362. The linkage further includes lever arms 364 coupled at an intermediate position to the link 358 and to an actuating bell crank 366 which is pivotally mounted by a pin 367. A cam 368 (FIG. 4) is provided and contacts an arm segment of the bell crank while a spring biasing means, not illustrated, is provided for forcing the bell crank to rotate in a clockwise direction. The cam is coupled to and rotated by a segment 372 of a single rotation, electrically energized clutch 374. The clutch is adapted for engaging a drive shaft 376 which is driven by a pulley 378. The drive shaft 376 extends to the inserter for each of the stackers. A pair of drive wheels 380 and 382 are also mounted on the shaft in each stacker. A pair of cooperating pinch rolls 384 and 386 are also provided. When the single revolution clutch 374 is energized, the cam rotates and the mechanical linkage causes the picker finger to bottom feed and advance a separator card between the drive and pinch rolls. The drive and pinch rolls then convey the separator card to the retractable support shelf 354.

Switch sensing means are provided for sensing the depletion of separator cards in the bin 80 and the absence of a separator card at shelf 354. When these conditions are sensed, an alarm light is energized on a display panel. The microswitch 391 is provided and is mounted in the bin 80 for actuation by the lower most card in the bin. When the bin is depleted of cards, the switch is actuated. Similarly, a microswitch 395 is positioned at the shelf location and the absence of a card at this location will permit actuation of the switch and energization of an alarm light.

A separator card is normally positioned at the retractable support shelf 354 and the card is transferred into the upper stacker immediately prior to the advancement of a succeeding separator card from the stack 56 and the separator bin. The retractable shelf 354 (FIG. 3) is mechanically coupled by a lever arm 388 which is pivotally mounted at its center, to the shelf transfer linkage at a lower portion thereof and to lever arm 390. The lever arm 380 is coupled to an arm 392 of bell crank 393 which is pivotally mounted by the pin 367. A lower arm segment 394 of the bell crank is engaged by a cam 396. An upper arm segment of the bell crank is biased by a spring means, which causes the bell crank to assume a clockwise home position. When the clutch 374 is engaged, as indicated hereinbefore, the cam 396 which is also coupled to the clutch is rotated and causes counterclockwise rotation of the bell crank 392. The mechanical linkage which couples the retractable support shelf to the bell crank is actuated thereby causing the shelf to expand momentarily and to release a card which is supported thereby to the upper stacker. The continued rotation of the cam 396 reforms the support shelf for receipt of a successive separator card which is transported thereto from the stack 56.

MECHANICAL DRIVE

Figure 5:
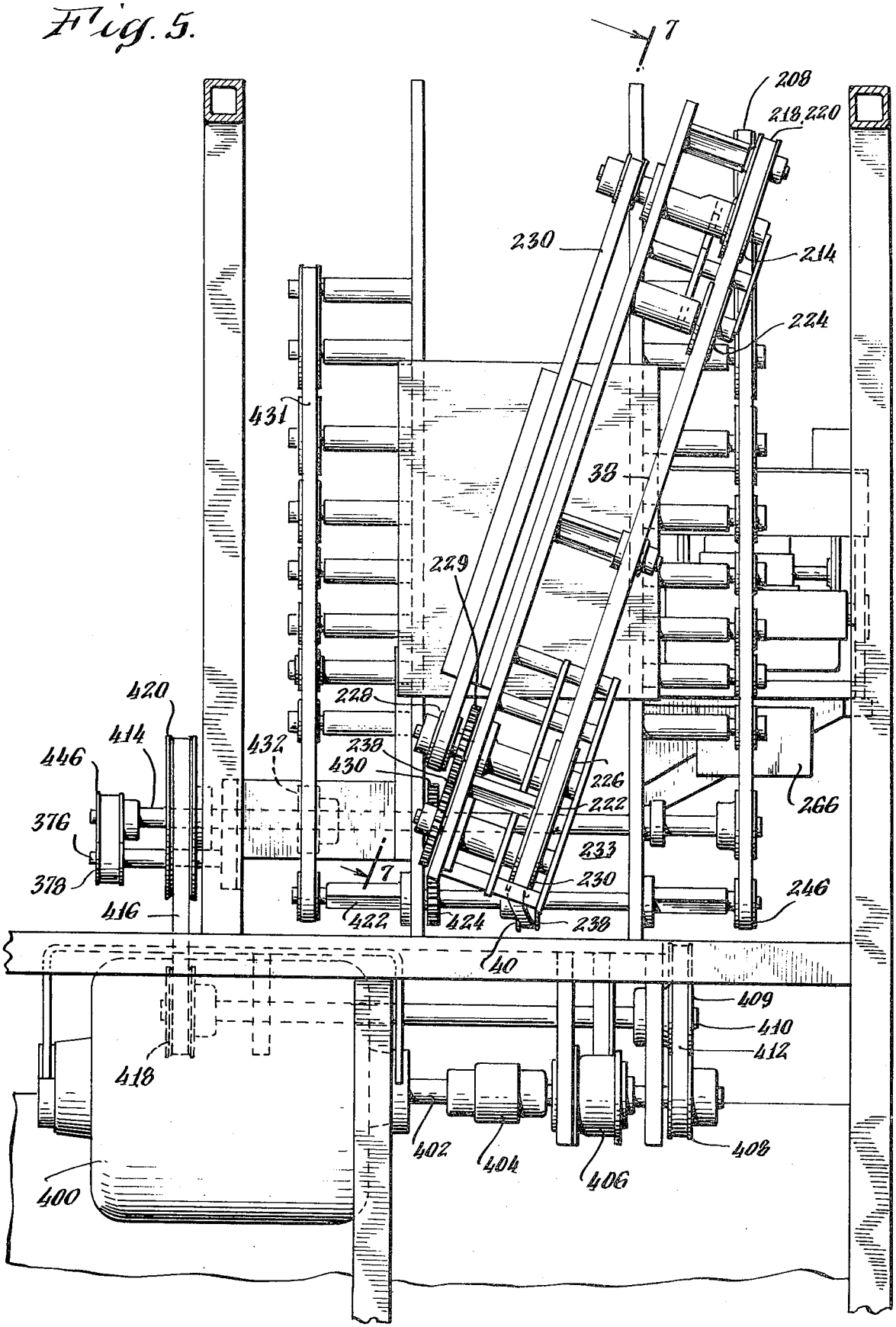
FIG. 5 is a rear elevation view of the apparatus of FIG. 3.
Figure 6:
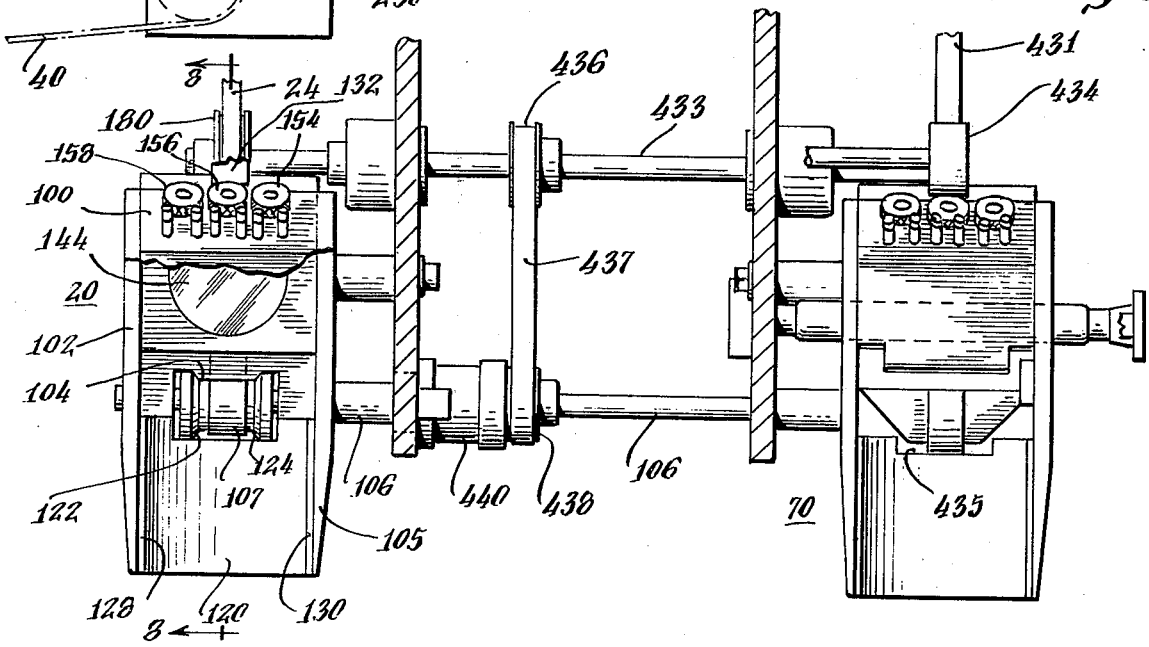
FIG. 6 is a view taken along lines 6—6 of FIG. 3.
Figure 8:
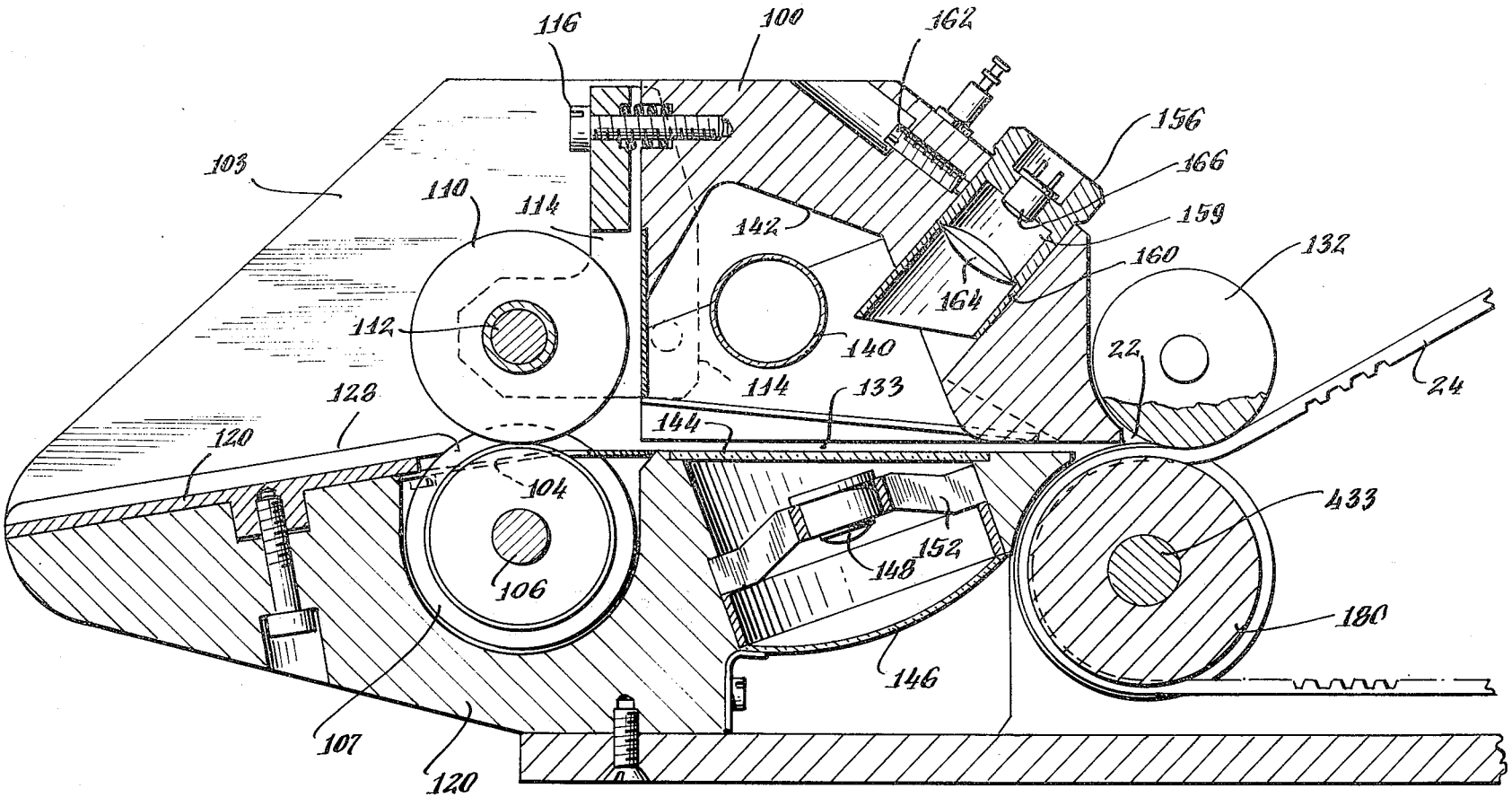
FIG. 8 is an enlarged sectional view of a scanning head of the apparatus taken along lines 8—8 of FIG. 6.

The mechanical drive for the various components thusfar enumerated is derived from an electric motor 400 (FIGS. 5 and 9). A drive shaft 402 of the motor is connected through a flexible coupling 404 to a brake 406 and a main drive pulley 408. Rotary motion is imparted to a pulley 409 which is mounted on jack shaft 410 through a belt drive 412. A main shaft 414 is driven from the jack shaft 410 by a drive belt 416 which is coupled between a pulley 418 on the jack shaft and a pulley 420 on the main shaft. A transfer belt shaft 422 is coupled to the shaft 414 and is driven by a gear 424 which is mounted on a shaft 422, a gear 426 which meshes with the gear 424 and which is driven by a gear 428 and a gear 430 which is mounted on the main shaft 414 and which meshes with the gear 428. The timing belt pulley 238 is secured to the shaft 422 and rotates therewith. The timing belt 40 is driven by this pulley and causes rotation of the pulley 236. Pulley 236 in turn drives the gear 238 and the gear 229. As indicated hereinbefore, the bill transfer timing belt 39 is driven by pulley 226 while the bill transfer riming belt 36 is driven by the pulley 214 to which rotary motion is coupled from the gear 229 by the pulley 228, the belt 230, the pulley 232 and a common mating shaft.

A bill transfer timing belt 431 is provided for transporting bills from the special head 70 to the associated stacker. This timing belt has associated timing belts, drives and pulleys in the same manner as the timing belt 24 which is associated with the scanner head 20. The timing belt 431 is driven by a timing belt pulley 432 (FIG. 5) which is mounted on the main shaft 414. Unlike the timing belt 24 which is coupled by an idle pulley 180 to a shaft 433, the timing belt 431 is coupled by a pulley 436 to the shaft 433 (FIG. 6) and drives the shaft 433. Rotary motion from the shaft 433 is imparted to the transport drive wheel 104 of the scanner head 20 and to a transport wheel 435 of the special scanner head 70, each of which is mounted to the shaft 106, through a pulley 436, a shaft belt 437, a pulley 438, and a clutch-brake 440. The clutch brake 440 is electrically energized for coupling between the pulley 438 and the shaft 106 in accordance with the characteristics of a bill being examined as determined by the apparatus. Rotary motion is imparted to the drive shaft 376 (FIG. 4) of the inserter separator card means through the pulley 378 and a drive belt 444 which is coupled to a pulley 450 on the main shaft 414.

As indicated in greater detail hereinafter, the apparatus of this invention is adapted to sense the condition of a bill being examined and continue in a run mode or to transfer to a stop mode. In the run mode, the main power brake 406 (FIG. 5) is de-energized while the clutch brake 440 is actuated to cause rotation of the shaft 106 and the drive wheels 104 and 435 of the scanning heads. During this run condition, bills are continuously fed by the operator to the scanner head 20 when currency is being examined and the shaft 106 will continue to rotate until the apparatus detects that a number of bills equal to a number in a preselected strap of bills has been introduced into the apparatus. When this condition is detected, the apparatus deactivates the clutch-brake 440 (FIG. 6) thereby disabling the rotation of the drive shaft 106 and terminating the rotation of the input transport drive wheel 104 for the head 20 and the input transport drive wheel 435 for the scanner head 70. However, the main drive shaft 414 continues to rotate and the various other elements enumerated hereinbefore are continuously energized. When a preprinted or demonetized bill is introduced into a scanner head, or when two postprint detector senses a malfunction in the operation of the inker printer 250, then the apparatus automatically energizes the motor drive shaft brake 406, de-energizes the motor, and de-energizes the clutch 440. All driven elements are thereby de-energized and a preprinted bill or a malfunction in the inker printer will immediately trap a bill in the apparatus. The apparatus can then be restarted upon clearing the bill and actuation of a keylock, the key for which is under the control of a supervisory operator.

CONSOLE

The compatibility and convenience in using the apparatus of this invention with a strap procedure for handling currency is further exemplified by the perspective view of the machine console in FIG. 1. The console includes a display panel 500 and counter displays 502, 504 and 506 for displaying the strap count of unfit, fit and special bills respectively. A total strap count indicator 508 is also provided adjacent an operator restart push button 510 which is actuated by the operator to reset the strap counter and, as indicated hereinbefore, to initiate transfer of the sorted bills from the upper to the lower stackers. Bills are fed to the regular scanner 20 or the special scanner 70 and the bills thus sorted by the apparatus are readily accessible in the regular upper stackers 46 and 42 and in the special upper stacker 76. Various other counter displays and associated setting means are provided including counter displays 512, 514, 516 and 518 which display the cumulative total of unfit, fit and special bills and the grand total of bills processed by the machine respectively. The console further includes a control 520 for selecting a regular operation wherein the apparatus examines currency items which are introduced to the scanning station 20. The control 520 alternatively can be rotated to select examination of special documents such as treasury notes, food stamps, etc. which are introduced into the special scanner head 70. In addition, the number of bills or documents in a strap is selectable by rotation of a selector switch 522 to a desired number. It is at times desirable to enter a predetermined count in the fit and unfit counters 502 and 504 respectively. This count can be introduced by manually setting mechanical counters 524 and 526 and actuating a push button 528 which causes the entry of this count into fit and unfit counters. Various other controls and indicator lamps are provided including preprint and postprint alarm indicators 528 and 530 respectively and an array of control push buttons 532 for enabling and disabling the application of power to the apparatus, etc. It will be noted from the view of FIG. 1 that the regular and special feed stations 20 and 70 respectively, the strap counter displays, the strap counter reset, and the various upper and lower stackers are arrayed in a manner for providing that an operator standing and facing the apparatus can efficiently and conveniently feed bills, monitor the sorting process, provide verification of the sorting of the strap and restart the machine upon verification.

LOGIC

Figure 14:
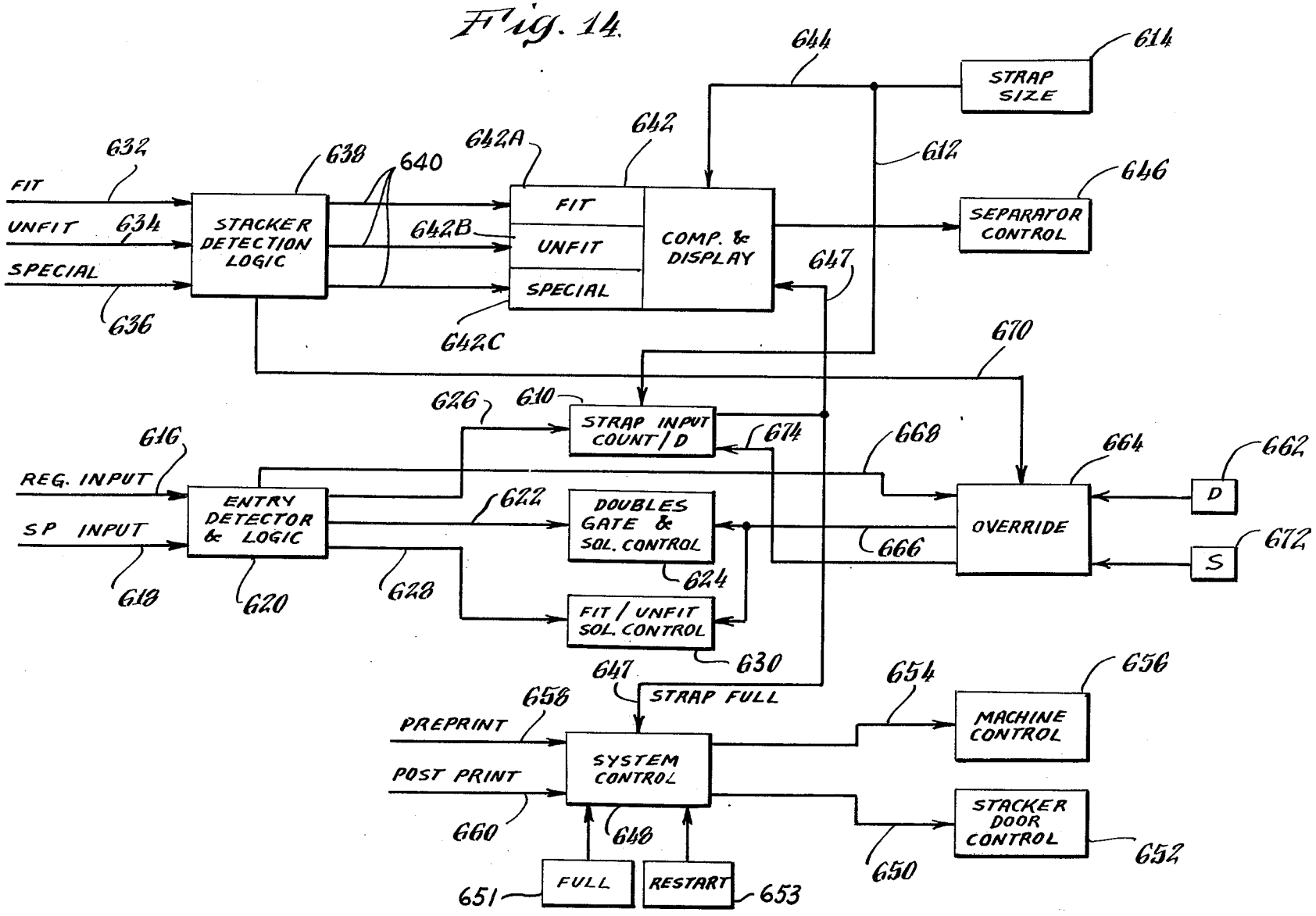

As indicated hereinbefore, the scanning head provides electrical signals representative of the transmissivity of a bill being examined and which is employed for forming a determination as to the fit or unfit character of the bill. These signals along with signals representative of the presence of a preprinted bill and detector signals from the various stacker input stations and postprinting detectors are employed for effecting control of the various operations of the apparatus which have been described hereinbefore. The manner in which the signals are generally utilized for controlling the operation of the apparatus will now be described with reference to the generalized block diagram of FIG. 14.

A principle counting system is illustrated as block 610 which provides for maintaining a totalized count of the strap input and display therefor. Strap size is provided as an input to the strap input counter along the line 612 from the strap size input device 614. Adjustment of the strap size input device 614 in accordance with the number of bills in a particular strap thereby indicates to the strap input counter 610 the total number of bills to be expected as a strap input condition. Activation of the strap input counter occurs in response to the entry of bills placed along the regular bill input line 616 or the special bill input line 618 through the entry detection and logic circuit 620. Sensing of the various entry conditions in accordance with the entrance of the bills along the input lines 616 and 618 will provide the appropriate decision within the entry detection logic circuit 620 for providing an indication as to whether the bill is to be rejected. If a regular input bill is not rejected, it will be further classified as a fit or unfit bill. If the bill is to be rejected, for example as a double, an appropriate signal is provided along the line 622 to the doubles gate and solenoid control circuitry 624 which in turn operates the appropriate doubles gate for regular or special double conditions as illustrated in FIG. 2. In addition, rejection of a bill will also apply a signal along the line 626 for inhibiting the strap input count as an appropriate input on the strap input counter 610.

If the bill provided along the regular input 616 is categorized as not falling within one of the doubles gate activation categories, the bill is then examined for quality. If the bill is determined to be unfit, an appropriate logic signal is provided along the line 628 to the fit-unfit solenoid control 630 which, in accordance with the detected quality condition of the bill as in its unfit state, provides an appropriate control to the fit-unfit control gate illustrated in FIG. 1. As each appropriate selection is made, the bills are stacked in their appropriate stackers. A regular bill is stacked in either fit or unfit stacks, while a special bill is merely stacked without quality analysis.

Detector blocks positioned at the bill entrance to upper stack provides a signal corresponding to inputting of each stacked bill. Thus, the appearance of a fit bill at the fit bill upper stacker will provide a logic signal along the line 632, an unfit stacked bill will provide a logic signal along the line 634 and a special stacked bill will provide a logic signal along the line 636.

The stack signals are fed to a stacker detection logic circuit 638 which provides appropriate output signals along the output lines 640 to a counter unit 642 which consists of individual counters 642A, 642B, and 642C, for counting each fit, unfit and special bill as they are collected. In accordance with the predetermined strap size provided from the strap size unit 614 along line 644 to the counter display logic unit 642, the separator control 646 will be activated in accordance with the completion of a strap count in any one of the fit, unfit or special counters. The appropriate separator control illustrated generally as 646 will thus be activated in accordance with achievement of a strap count in any of the counter units described generally in the block 642, causing activation of the separator mechanism and inserting a separator into the proper upper stacker as was described in conjunction with FIG. 2.

Completion of the predetermined strap input count in the counter 610 will provide an appropriate logic signal along the line 647 indicating a strap full condition to a system control unit 648. The effect of the strap full signal along the line 647 to the system control unit 648 will result in stopping further bill feed into the machine. Machine feed shutdown upon activation of the strap full line is accomplished by an appropriate output signal provided along the line 654 to a machine control operating mechanism 656 which provides the input drive stop feature necessary for the accomplishment of this function. Reactivation of the machine by activation of the full input signal 651 to the system control unit 648 will provide an output signal along the line 650 to the stacker door control 652. The function of the stacker door control will be, as described in FIG. 2, to open the doors on each of the upper stackers described in FIG. 2 and permit the bills accumulated thus far therein to drop into the lower stacker. The FULL control will also reactivate the feed control mechanism through block 656.

Since the strap size data from unit 614 has also been entered into the block 642, the separator control 646 will cause the appropriate separator to drop into the appropriate upper stacker when a full strap size is achieved in one of the fit, unfit or special stacker units, in accordance with operation of the separator control as described above.

As was set forth above, the machine includes a demonitization function. It is thus important to monitor two conditions. First, whether a demonetized bill is being scanned (preprint detection) and second, whether the printing equipment is working properly (postprint detection). In the first condition, a signal from the preprint detector is analyzed to determine whether an entered bill has been demonetized. If it has, a logic signal applied along line 658 to the system control 648 activates a shutdown sequence to machine control unit 656 which will disable both input feed drive and main motor drives, shutting down the machine. An alarm light or other indication may also be provided. In the second condition, a signal from the postprint scanner is analyzed to determine if the bill has been properly demonetized. If it has not, a logic signal is applied along line 660 to the system control 648 to activate a shutdown sequence to machine control unit 656 which will first disable the input feed drive and, after a delay sufficient to allow previously demonetized bills to exit the machine, shut down the main motor drive.

Reactivation of the machine after a preprint or postprint shutdown is effected by depressing the RESTART control 653 which resets the system control 648 and permits reactivation.

As was set forth above, activation of the doubles gate will result in rejection of a bill. The options available to the operator after rejection include reinsertion of the bill, in which event the machine merely functions as it did in the previous cycle, or activating a machine override. The purpose of the machine override will be to automatically demonetize a bill without the improper entry or quality decision features described above. Thus, activation of a doubles override by means of appropriate input 662 to the override logic 664 provides an appropriate signal along the line 666 to clamp the doubles gate so as not to reject the bill while at the same time clamping the fit/unfit gate solenoid control 630 to pass the bill through the demonetizing section described in FIG. 2. The operation of the logic override 664 in this doubles mode is set by the input 662 and triggered upon receipt of a signal indicating that the now entered bill has reached the proper position within the sensing head. The signal of larger magnitude is provided from the entry condition detection circuit 620 along the line 668. The operation can only be accomplished once for each double override, the resetting of the override circuit 664 occurring when each double override entry bill is fed into the unfit stacker detector as indicated by the appropriate signal then applied along line 634 to the stacker detection logic 638 and along the output line 670 to the override logic 664.

A supplemental override operation is provided by means of the override input 672. The override input 672 function is to demonetize the special bills. In this instance, activation of the specials function 672 will provide an appropriate signal to the override logic 664 for again deactivating the doubles gate and clamping the fit/unfit solenoid control 630 to its unfit condition. In this mode, however, accumulation of demonitized specials is accomplished in the unfit stacker and operates continuously without reset until the specials override function 672 is again activated, thereby placing the override logic 664 in its initial condition.

The demonetization of special bills is accomplished after collection of specials in the specials stacker. Demonetization of specials is effected by re-feeding stacked specials into the Regular input, again with the doubles gate clamped to prevent rejection, and with the fit/unfit gate clamped to the unfit position. To prevent erroneous counts, the override logic will provide an inhibit signal along line 674 to the strap input counter 610 upon activation of the specials override function 672 to inhibit re-counting of specials for demonetization.

This logic arrangement is described in greater detail and is claimed in a copending U.S. Patent application Ser. No. 457,375, now U.S. Pat. No. 3,932,272, filed concurrently herewith and which is assigned to the assignee of this invention. The disclosure of this copending application is incorporated herein by reference.

There has thus been described an improved method and apparatus for the examination of currency and other forms of documents. The apparatus provides for an increased degree of discrimination between fit and unfit bills through both optical and electrical intregration of the light transmissivity of the bill over a major portion of the surface area of the bill. The apparatus further provides for discrimination between bill doubles which result from bills adhering one to the other or overlapping and for automatically demonetizing those bills which have been determined to be unfit. The fit and unfit bills are sorted and are automatically segregated into stacks having a number of bills equal to a predetermined number. These and other features have been enumerated in detail hereinbefore.

Although particular embodiments of the invention have been described herein, it will be appreciated by those skilled in the art that variations may be made therefrom without departing from the spirit of the invention and the scope of the appended claims.

What is claimed is:

1. A method for examining and determining the wear characteristics and fitness of currency bills which can be soiled, worn, damaged, and the like, comprising the steps of:

transporting a bill through an examination station;

projecting a beam of light at the bill as the bill is transported through said station, said beam of light bathing substantially the entire surface of the bill with light;

sensing the intensity of light transmitted through said bill at said station and providing an electrical signal indicative of said intensity;

integrating said electrical signal to form an integrated electrical signal indicative of substantially the entire energy of the light transmitted through said bill; and comparing the integrated signal of the intensity signal with a signal of predetermined magnitude representative of a passable fitness energy so that the fitness of the examined bill is determined.

2. The method of claim 1 wherein an examined bill is transported from the examination station over a first course and is deposited in a first collection means when the bill exhibits a predetermined light transmissivity characteristic of a fit bill, and alternatively is transported over a second course and deposited in a second collection means when the bill exhibits a predetermined light transmissivity characteristic representative of an unfit bill.

3. The method of claim 2 including the step of comparing the electrical signal representing transmitted light intensity with a second reference signal indicative of two overlapping bills and if two overlapping bills are indicated, then transporting said two overlapping bills from said examination station over a third course to a receiving means.

4. An apparatus for examining and determining the wear characteristics and fitness of currency which can be soiled, worn, damaged, and the like, comprising:

means defining a currency examination station;

transport means for receiving and transporting a bill through said examination station;

projecting means for projecting a beam of light at substantially the entire surface of a bill at the examination station as said bill is transported through said examination station;

detecting means disposed adjacent said projecting means for detecting the level of light transmissivity through said bill and for providing an electrical signal representative of said intensity;

integrating means operatively connected to said detecting means for integrating said electrical signal during the transport of said bill through said examination station, said integrated signal being indicative of substantially the entire energy of the light transmitted through said bill;

comparing means operatively connected to said integrating means for comparing the integrated signal with a reference signal representing a passable fitness energy, and forming a determination of the fitness of a bill which is examined;

signalling means operatively connected to said comparing means for providing an electrical signal which is representative of the fitness of a bill being examined; and conveying means operatively connected to said signalling means for conveying an examined bill from the examination station in response to the fitness determination signal through means defining a first course to a first bill collecting means, and alternatively through means defining a second course to a second bill collecting means.

5. The apparatus of claim 4 including double detection means for providing a reference electrical signal representative of the light transmissivity of two overlapping bills at the examination station, second comparing means operatively connected to said double detection means and said integrating means for comparing the reference signal with the integral of the electrical signal representative of the light transmissivity of a single bill, aand for giving an indication of overlapping bills, and conveying means operatively connected to said second comparing means for transporting a bill through means defining a third course to a third collecting means in response to the overlapping indication of said second comparing means.

6. The apparatus of claim 4 including first and second storage means associated with said first and second collecting means, respectively, and means for transferring the bills from said first and second collecting means to said first and second storage means respectively when a predetermined number of bills have been transported through said examination station.

7. The apparatus of claim 4 wherein said first and second collecting means are positioned in juxtaposition to each other and said conveying means for conveying a bill from the examination station includes a bill transport and guide means for conveying a bill through said first course to a first transfer station in a first general direction of movement which is the same as that of the movement of the bill through the examination station, then conveying the bill from the first transfer station to a laterally displaced second transfer station, and they conveying the bill from said second transfer station in a direction generally opposite direction to that of the first direction to a collecting means.

8. The apparatus of claim 4 including means for automatically depositing a bill separator in at least one of said collecting means when a predetermined number of bills have been deposited into the collecting means.

9. The apparatus of claim 8 wherein said means for depositing a separator comprises a storage bin adapted for containing a plurality of separating sheets, counting means for maintaining a count of the number of bills which have been deposited in each of said collecting means, and transfer means operatively connected to said counting means for transferring a sheet from said bin to each respective collecting means when the respective number of bills deposited in each of said collecting means attains a predetermined number.

* * * * *

UNITED STATES PATENT OFFICE
CERTIFICATE OF CORRECTION

Patent No. 3,976,198 Dated August 24, 1976

Inventor(s) W. Robert Carnes, Jr.; Lester L. Selnick; John Balogh, Jr.

It is certified that error appears in the above-identified patent and that said Letters Patent are hereby corrected as shown below:

Column 1, line 16, before "have" insert --States--;
delete "hahve".

Column 5, line 16, change "Its" to --At--;
line 19, change "detectionn" to --detection--;
line 23, change "interruped" to --interrupted--.

Column 6, line 55, change "demonetizing" to --demonetize---.

Column 7, line 61, change "2" to --3--.

Column 8, line 1, change "a" to --A--.

Column 10, line 27, change "25" to --26--;
line 36, change "loading" to --leading--.

Column 12, line 43, change "bils" to --bills--.

Column 13, line 51, change "380" to --390--.

Column 14, line 36, change "436" to --434--;
line 41, change "shaft" to --drive--.

Column 16, line 38, after "count" insert --and display 610. Thus a rejected bill is not counted--.

UNITED STATES PATENT OFFICE
CERTIFICATE OF CORRECTION

Patent No. 3,976,198 Dated August 24, 1976

Inventor(s) W. Robert Carnes, Jr.; Lester L. Selnick; John Balogh, Jr.

It is certified that error appears in the above-identified patent and that said Letters Patent are hereby corrected as shown below:

Column 20, Claim 7, line 45, change "they" to --then--.

Signed and Sealed this thirtieth Day of August 1977

[SEAL]

Attest:

RUTH C. MASON
*Attesting Officer*

C. MARSHALL DANN
*Commissioner of Patents and Trademarks*